US008668195B2

(12) United States Patent
Ledgerwood et al.

(10) Patent No.: US 8,668,195 B2
(45) **Date of Patent: *Mar. 11, 2014**

(54) MEDIA DIVERTER APPARATUS

(75) Inventors: Adam D Ledgerwood, Geneva, NY (US); Carlos M Terrero, Ontario, NY (US); Donald R Fess, Rochester, NY (US); Joseph Marasco, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 415 days.

This patent is subject to a terminal disclaimer.

(21) Appl. No.: 12/881,229

(22) Filed: Sep. 14, 2010

(65) Prior Publication Data

US 2012/0063828 A1 Mar. 15, 2012

(51) Int. Cl.
*B65H 29/00* (2006.01)

(52) U.S. Cl.
USPC ..... 271/186; 271/303; 271/301

(58) Field of Classification Search
USPC ..... 271/303, 186, 184, 225, 296, 301; 399/401
See application file for complete search history.

(56) References Cited

U.S. PATENT DOCUMENTS

| | | | | |
|---|---|---|---|---|
| 4,359,217 | A | 11/1982 | Roller et al. | |
| 6,533,271 | B1 * | 3/2003 | Zimmermann | 271/303 |
| 7,093,831 | B2 * | 8/2006 | Biegelsen et al. | 271/184 |
| 7,108,260 | B2 * | 9/2006 | Biegelsen et al. | 271/303 |
| 8,276,913 | B2 * | 10/2012 | Bianco et al. | 271/303 |
| 2005/0189712 | A1 * | 9/2005 | Carter et al. | 271/303 |

OTHER PUBLICATIONS

U.S. Appl. No. 12/783,795, filed May 20, 2010, and entitled "Letterbox Media Diverter" by Richard G. Hubbard, et al.

* cited by examiner

*Primary Examiner* — David H Bollinger

(57) ABSTRACT

A multi-position letterbox media diverter that maximizes productivity includes a gate configured like a tomahawk to allow sufficient space for the diverter to operate immediately after the trail edge of a sheet passes the front edge of the gate and thereby increase gate actuation time. Reversible drives of an inverter are used to direct the sheet to a duplex path while another sheet is simultaneously directed by a lower integrated baffle portion of the gate to an output tray as needed. Thus, reducing the time required for the sheet to be in the inverter path before reversing sheet direction, thereby facilitating a reduction in required transport speed.

19 Claims, 2 Drawing Sheets

MEDIA DIVERTER APPARATUS

CROSS-REFERENCE TO RELATED APPLICATIONS

Cross-reference is hereby made to commonly assigned U.S. application Ser. No. 12/783,795, filed May 20, 2010, now U.S. Pat. No. 8,276,913, and entitled "Letterbox Media Diverter" by Richard G. Hubbard, et al. The disclosure of the heretofore-mentioned application is incorporated herein by reference in its entirety.

BACKGROUND

1. Field of the Disclosure

The present disclosure broadly relates to xerographic printers, and more particularly, to an improved diverter apparatus for use in xerographic printers and other machines of the like.

2. Description of Related Art

In the field of reprographic machines, it is often necessary to feed along one of two alternative paths a copy sheet leaving the process of a machine, particularly, when the machine can selectively produce simplex (one-sided) and duplex (two-sided) sheets. Simplex sheets may be fed directly to an output tray, whereas the duplex sheets may pass to an inverter nip which automatically reverses the direction of movement of a simplex sheet and feeds it back into the processor, but inverted, so that the appropriate data can be applied to the second side of the sheet. An example of such is shown in U.S. Pat. No. 4,359,217 that includes three rollers in frictional or geared contact with each other, to provide two spaced-apart nips, one being an input nip to an In addition, known printing systems commonly include two or more media transport paths that divert from one another at certain points and join one another at other points. Thus, a given sheet of media can normally be transported thorough a known printing system along any one of a variety of transport paths. Upon reaching one the diversion points, a sheet of media will not itself select the appropriate media transport path along which movement is desired. As such, mechanical diverters are typically provided immediately in front of the divergent transport path to deflect the sheet long the desired pathway. One example of such a known mechanical diverter includes a gate that extends across the media transport path immediately in front of the diversion point of the transport path. The gate includes an upstream edge and a downstream edge, and is oriented along the transport path such that the downstream edge is pivotally supported at approximately the diversion point of the transport pathway. Thus, the gate creates a diagonally extending blockage across the pathway that is displaceable between first sand second positions corresponding to a sheet media diversion along the first and second transport paths.

These types of diverter gates have drawbacks in view of the advancing performance of printing systems in view of the timing between the passing of a first sheet of media, the movement of the gate to a different position, and the arrival of the second sheet of media. That is, a given printing system will operate using a predetermined inter-document gap (IDG), which generally refers to the spacing between the trailing edge of a first sheet of media and the leading edge of a second sheet of media. However, as the output performance of printing systems continues to be improved, increasingly smaller IDGs are expected to be used.

It is well known that the arrival of a second sheet of media at the diversion point prior to a gate reaching a desired position could result in the leading edge of the sheet of material contacting the upstream edge of the gate and thereby creating a jam or other undesirable condition. It will be recognized then that as increasingly smaller An inverter that addresses some of the above-mentioned issues is disclosed in the heretofore mentioned U.S. application Ser. No. 12/783,795, which includes a multi-position letterbox media inverter that reduces the distance a sheet has to travel before diverting it into a duplex path and thereby increases machine performance. In this letterbox configuration, the trailing edge of an exiting sheet must in effect be at an exit nip before an inversion process can reset.

Therefore, a diverter assembly is still needed that overcomes the foregoing and other problems and difficulties while simultaneously increasing reaction time of the diverter assembly.

BRIEF SUMMARY OF THE DISCLOSURE

Accordingly, an improved multi-position letterbox media diverter is disclosed that maximizes productivity. The diverter includes a gate mounted on an arm and configured like a tomahawk to allow sufficient space for the gate to operate immediately after the trail edge of a sheet passed a front edge of the gate to thereby increase gate actuation time. Reversible drives of an inverter are used to direct the sheet to a duplex path while another sheet is simultaneously directed by a lower integrated baffle portion of the gate to an output tray as needed. Thus, reducing the time required for the sheet to be in an inverter path before reversing sheet direction, thereby facilitating a reduction in required transport speed.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
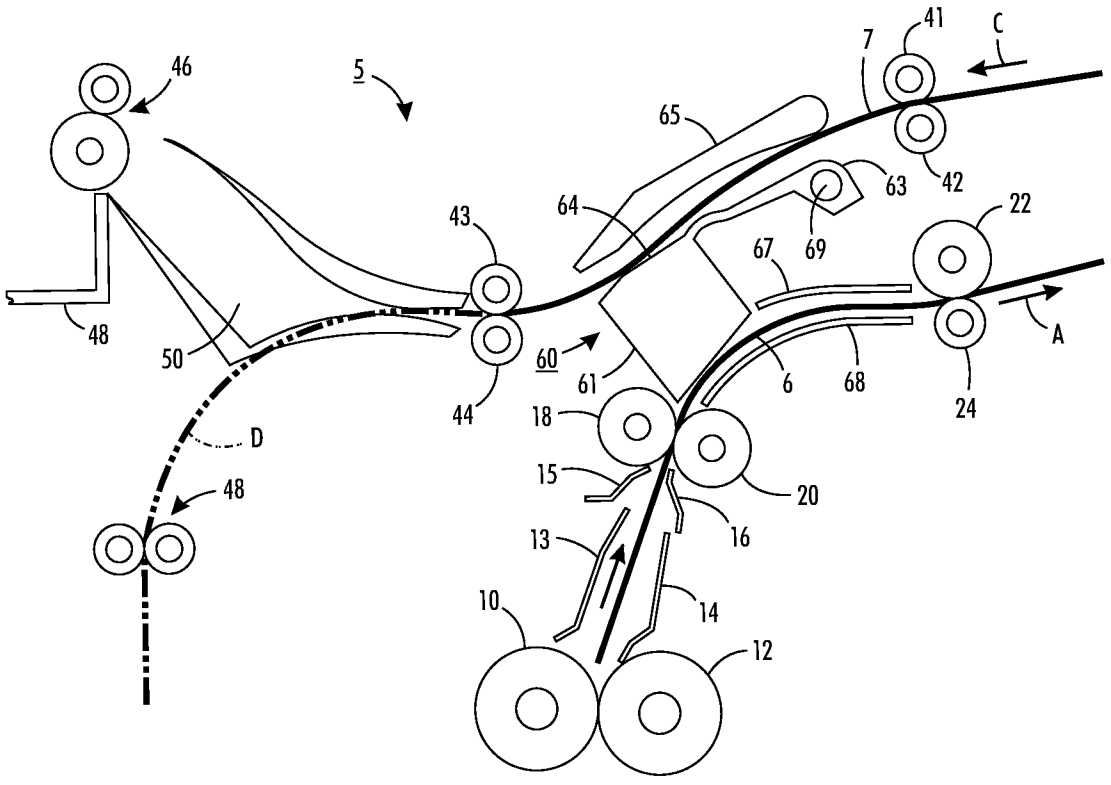
FIG. 1 is a partial frontal view of a printer apparatus that incorporates an improved letterbox diverter in a first or home position in accordance with the present disclosure.

Turning now to the drawings wherein the showings are for the purpose of illustrating an exemplary embodiment and not intended as a limitation, FIG. 1 illustrates a partial frontal view of a printer apparatus 5 with multiple media paths for accomplishing the printing of simplexed (one sided) and duplexed (two sided) media with the use of a dual positioning letterbox media diverter.

As shown in FIG. 1, a sheet of media 6 has just exited a fuser nip comprised of fuser roll 10 and a backup roll 12 and transported through baffles 13, 14 and baffles 15 and 16 into a post fuser nip formed between drive roll 18 and idler roll 20 and then into letterbox media diverter 60. Letterbox diverter or gate 60 is a multi-positioning diverter that directs a sheet 6 into a simplex path in the direction of arrow A when in a first or home position shown in FIG. 1 while simultaneously guiding a sheet 7 into a duplex path in the direction of arrow C. Sheet 6 in FIG. 1 has been met by the letterbox diverter 60 in its home or first position and has been diverted in the direction of arrow A into a first output nip formed between drive roll 22 and idler roll 24 for subsequent forwarding into an output tray. While in this home position, letterbox diverter 60 directs Letterbox diverter 60 comprises a three part gate including the top half 65 of a baffle that controls the top surface of media being duplexed. Arm 63 serves as the bottom half of the baffle during the inversion path, as well as, the connection location to the pivot shaft 69. In addition, rotating arm 63 controls the bottom surface of media being duplexed. Block member 61 is connected to arm 63 to form a tomahawk shaped section of the gate (i.e., a relieved or open area extending from block member 61 to pivot shaft 69). This arrangement insures that the gate will not interfere with an outgoing sheet as it resets to receive the next sheet to be inverted. In addition, it accomplishes inversion of sheets in a small space envelope, reduces the time to reverse direction, reduces process speed time, and eliminates the need for additional guide baffles. The top edge 64 of the tomahawk shaped section of the gate controls the bottom surface of the media being duplexed. The lower edge 62 of the tomahawk shaped section of the gate controls the top surface of the media exiting the printer. Top exit baffle 67 and bottom exit baffle 68, respectively, controls the top and bottom surfaces of media exiting the printer. In FIG. 1, gate 60 is shown in its up position. This is the position used for a sheet to move into the duplex path after inversion, as well as, out of the exit path. A sheet 7 is shown exiting the inversion nip while a sheet 6 is shown simultaneously exiting the printer.

With further reference to FIG. 1, a sheet 7 captured in the nip formed between reversible rolls 41 and 42, for inversion and subsequent duplexing, is shown driven into the duplex path and through a nip formed between drive roll 43 and idler roll 44 into a dual positioning deflector mechanism 50 which, in a first position, deflects the sheet into a second output nip 46 which in turn drives the sheet into a second output tray 48. Deflector mechanism 50, in a second position, deflects the sheet along dotted duplex Letterbox diverter 60 is shown in FIG. 1 in its home position feeding a sheet 6 into a nip formed between drive roll 22 and idler roll 24 while simultaneously transporting a sheet 7 out of the diverter through duplex path C. The diverter is rotated on shaft 69 between the home position of FIG. 1 to a second position shown in FIG. 2 for feeding sheets into the inversion nip formed between drive roll 41 and idler roll 42. Movement of the diverter from its home position to an actuated position is triggered by the position of the trail edge of the sheet that is within the diverter.

Figure 2:
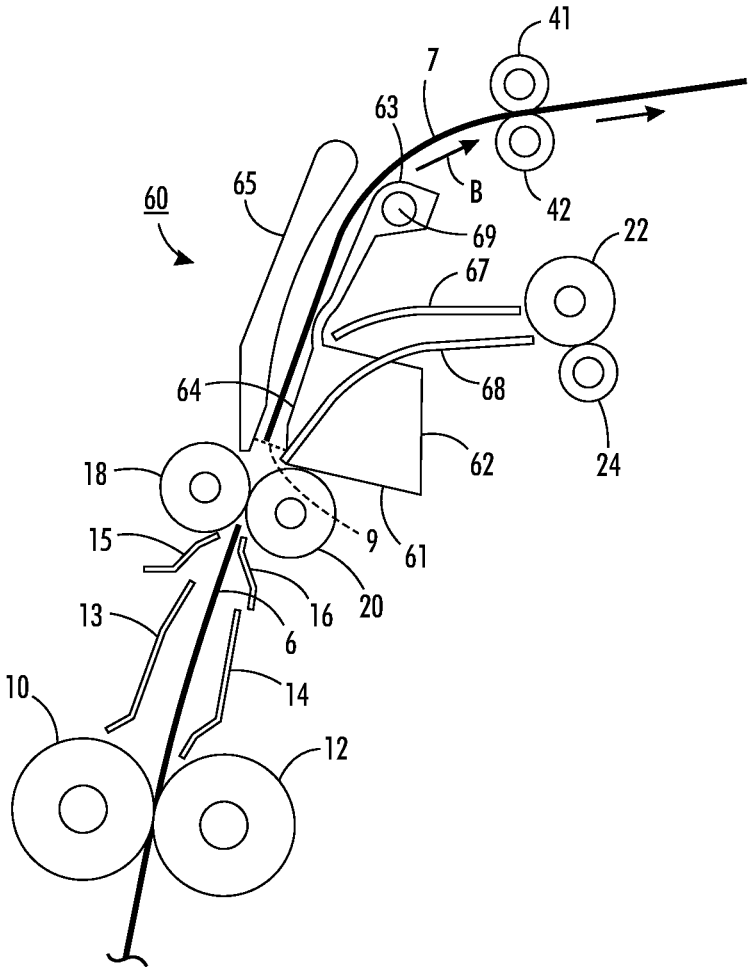
FIG. 2 is a partial frontal view of the printer apparatus of FIG. 1 showing the improved letterbox diverter in a second or actuated position.

In FIG. 2, gate 60 is in its down position. This is the position used for a sheet entering the inversion nip to go around the duplex path. Once the paper has cleared the entry edge of the gate (dashed line 9) it can begin to swing to the up position while the sheet is still inside. This allows for a shorter duplex paper path, as well as, the gate resetting for sheets to exit the machine quicker. For every millimeter of distance the sheet does not have to move further up the gate, there is a 2 mm reduction in length of the duple path, since the sheet also does not have to then travel back down the gate.

It should now be understood that an improved diverter arrangement has been disclosed that increases the productivity of a printer through shorter inner document gaps and faster gate transition times. In addition, mass is reduced in the tip of the gate and thereby reducing torque required to rotate the gate over gates used heretofore. These enhancements are accomplished with the use of a letterbox diverter configuration that enables the diverter to operate immediately after the trail edge of a sheet passes the entry edge of the gate. The letterbox gate moves to direct the sheet to an invert path so that reversing drives of an inverter can be actuated. This reduces the time required for the sheet to be in the inverter path before reversing sheet direction.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A reprographic device, comprising:

a first path for directing simplexed and duplexed media into and output location;

a second path for directing simplexed media into an inverter;

a duplex path for directing inverted simplexed media to receive an image on a non-imaged side thereof; and a multi-mode diverter adapted when in a first mode to receive simplexed media from said first path and direct it to said output location while simultaneously directing an inverted simplexed media with a top surface portion thereof into said duplex path; and when in a second mode directs simplexed media into said inverter with said top surface portion thereof, and wherein said multi-mode diverter includes a gate member configured to include a head member supported by a shaft mounted rotatable arm and an open section thereof positioned between said head member and said shaft to insure that said gate will not interfere with outgoing media as it resets to receive the next media to be inverted, and thereby increasing reaction time of said diverter.

2. The reprographic device of claim 1, wherein said multi-mode diverter includes an upper portion that complements said top surface portion to form a channel therethrough.

3. The reprographic device of claim 2, wherein said head member is trapezium shaped block.

4. The reprographic device of claim 3, wherein said block member includes a bottom surface portion thereof that serves as a baffle for directing simplexed and duplexed media into said output location.

5. The reprographic device of claim 1, wherein said multi-mode diverter is an integral three piece member.

6. The reprographic device of claim 5, wherein said inverter is positioned above said multi-mode diverter.

7. The reprographic device of claim 6, wherein said inverter comprises reversible rolls that form a nip therebetween.

8. The reprographic device of claim 7, including a fuser, and wherein said diverter is located downstream of said fuser and upstream of said inverter.

9. The reprographic device of claim 8, including a dual positioning deflector positioned downstream of said inverter and adapted when in a first position to deflect media from said duplex path to a catch tray and when in a second position to deflect media along said duplex path to said output location.

10. The reprographic device of claim 1, wherein said multi-mode diverter is actuated from said first mode to said second mode immediately after media has cleared a front end thereof.

11. A dual positionable diverter for use in a reprographic apparatus for directing sheets in multiple directions, comprising:

integral upper and lower portions with said lower portion being supported by an arm integral therewith for rotational movement, said upper and lower portions forming a channel extending threrebetween for the passage of sheets therethrough; a rotatable shaft on which said diverter is mounted for rotation from a home position to an activated position; and wherein said lower portion and said arm are configured to present a cavity between said lower portion and said shaft so that said diverter can be moved from said home position to said activated position once a sheet has cleared an entry point of said diverter, and wherein said diverter is in said home position when guiding a sheet to an output nip while simultaneously guiding another sheet away from an inverter and into a duplex path.

12. The dual positionable diverter of claim 11, wherein said diverter is in said activated position when guiding a sheet into said inverter.

13. The dual positionable diverter of claim 12, wherein said diverter is moved from said home position to said activated position immediately after a trail edge of a sheet passes said entry point.

14. The dual positionable diverter of claim 13, wherein a top surface of said lower portion of said housing guides a sheet into said inverter and into said duplex path.

15. The dual positionable diverter of claim 14, wherein said inverter comprises reversible rolls.

16. The dual positionable diverter of claim 15, wherein said lower portion includes a bottom surface that functions as is an output baffle.

17. The dual positionable diverter of claim 16, wherein said arm controls the bottom surface of sheets being duplexed.

18. The dual positionable diverter of claim 11, wherein said diverter includes two input paths and one exit path.

19. The dual positionable diverter of claim 11, wherein said upper portion controls the top surface of sheets being duplexed.

* * * * *